United States Patent [19]

Kerns et al.

[11] 4,402,443

[45] Sep. 6, 1983

[54] RISER REMOVAL DEVICE

[75] Inventors: Victor L. Kerns, Barnhart; David A. Sager, Florissant, both of Mo.

[73] Assignee: AMSTED Industries Incorporated, Chicago, Ill.

[21] Appl. No.: 253,318

[22] Filed: Apr. 13, 1981

[51] Int. Cl.[3] ..... B26F 3/00

[52] U.S. Cl. ..... 225/103; 225/1

[58] Field of Search ..... 225/103, 93, 1; 425/806, DIG. 51

[56] References Cited

U.S. PATENT DOCUMENTS

| | | | |
|---|---|---|---|
| 3,102,672 | 9/1963 | Schiffers et al. | 225/103 |
| 4,221,315 | 9/1980 | Latchague | 225/103 X |
| 4,347,957 | 9/1982 | Rögener | 225/103 X |

FOREIGN PATENT DOCUMENTS

| | | | |
|---|---|---|---|
| 55-64960 | 5/1980 | Japan | 225/103 |

*Primary Examiner*—Frank T. Yost

*Attorney, Agent, or Firm*—Edward J. Brosius; Fred P. Kostka

[57] ABSTRACT

This invention relates generally to a device for removing risers or the like from metal castings. The device generally includes a frame on which there is mounted a power actuated means for fracturing and separating the riser from the casting and a retaining and locating means which serves to locate and retain the power actuated means in a position in which it is operative to strike the riser and separate it from the casting.

2 Claims, 6 Drawing Figures

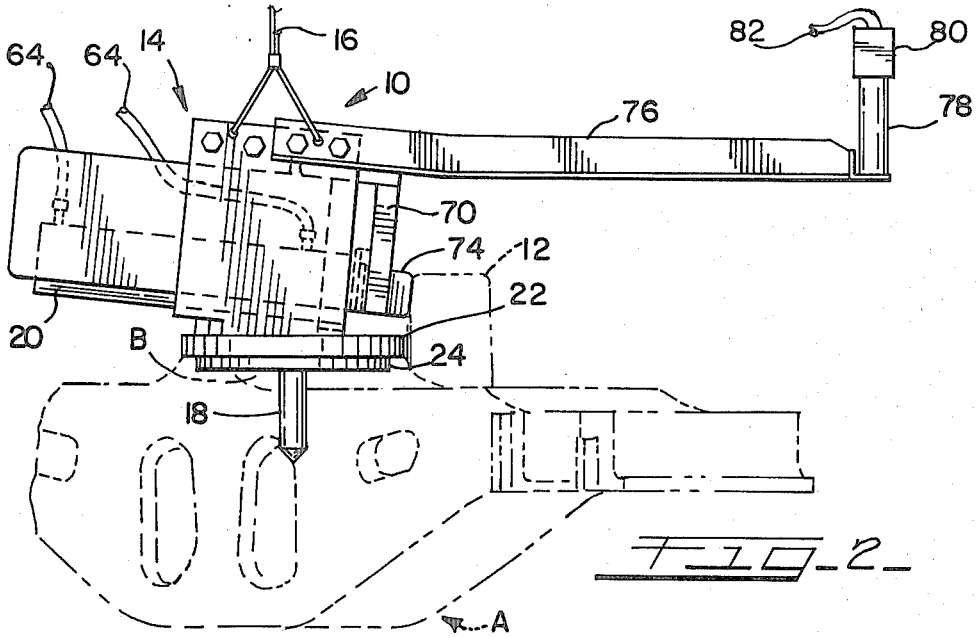
FIG. 2
FIG. 1
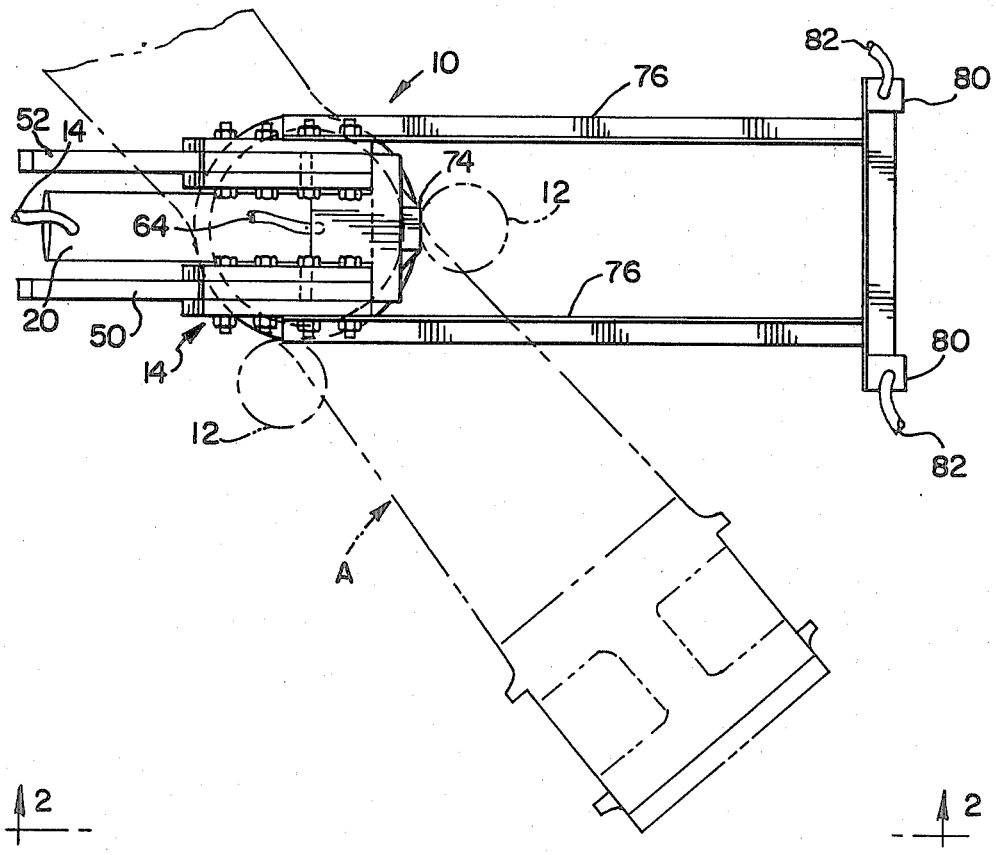

RISER REMOVAL DEVICE

BACKGROUND OF THE INVENTION

1. Field of Invention

The present invention relates to devices for cleaning metal castings and more particularly to a device for removing risers and similar non-functional projections from the finished casting.

2. Prior Art

In present day foundry practice, molds are provided with riser openings formed on the cope side to serve as reservoirs for molten metal. These reservoirs supply extra metal to feed the voids formed by shrinkage as the metal cools and passes from the liquid to the solid state. When the cast article is removed from the mold, the solidified metal in the opening remains attached to the casting as a projection which is commonly referred to as a riser. These risers are non-functional and are subsequently removed. Heretofore, removal of the risers is accomplished by sledge hammers and cutting torches which are costly processes as well as safety hazards.

SUMMARY OF THE INVENTION

In accordance with the present invention, there is provided a riser removal device for castings which overcomes the inefficient and hazardous method of riser removal encountered heretofore. This is accomplished generally by transferring an increasing force from a hydraulic cylinder to the riser. A locating means is also mounted on the frame and is constructed so as to fit or seat on a convenient structural element of the casting so as to position the actuating means for application of a fracturing force to sever or break the riser from the casting.

BRIEF DESCRIPTION OF THE DRAWINGS

FIG. 1 is a top plan view of a riser removal device embodying the present invention.

FIG. 2 is a side elevational view of the device of FIG. 1, taken generally along line 2—2.

DESCRIPTION OF THE PREFERRED EMBODIMENT

Figure 3:
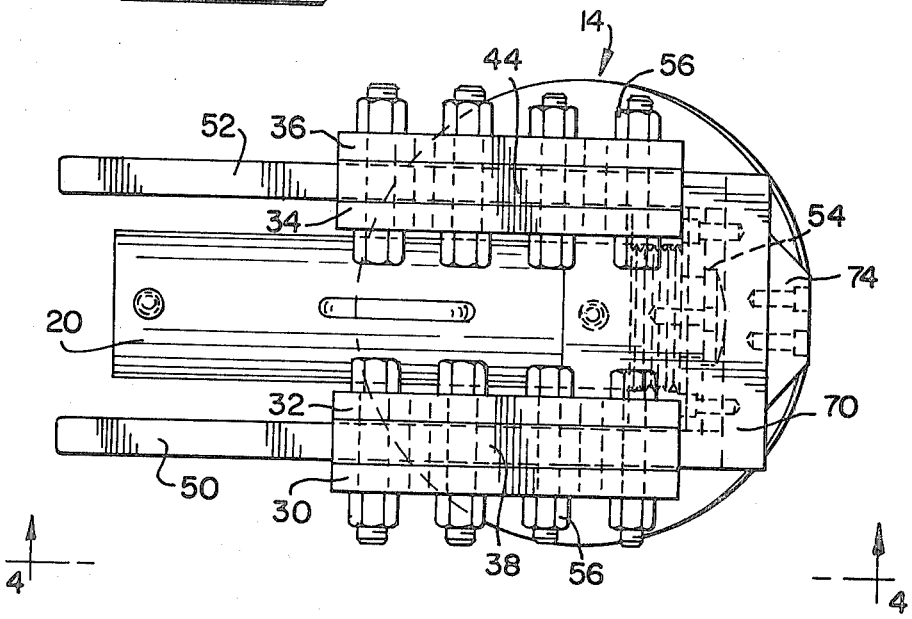
FIG. 3 is an enlarged top plan view of the device of FIG. 1 with the handle means omitted.

Referring now to the drawings, in particular FIG. 1, a riser removal device 10 embodying the structure of the present invention is shown positioned to remove a riser 12 from a railway vehicle bolster casting A. While the removal device 10 is illustrated for removing risers from a bolster casting A, it should be readily apparent that the device 10 may be applicable to remove projections from other castings provided a fixed element on said casting is spaced at a predetermined distance from the riser projections as will be more fully described hereinafter.

The railway vehicle bolster casting A conventionally includes a longitudinally elongated body having a circular center plate B in the center thereof for supporting a car body. A center portion of the center plate defines a retaining means or opening fittable or seatable with a portion of a railway car body. The riser projections are located at critical areas of the casting where extra metal is required to feed the voids formed by shrinkage. One of such areas is along the circumference of the center plate B so that each riser 12 is equidistant from the center plate opening. Risers 12 are generally formed at the rim of the center plate B, on each side of the longitudinal axis of the bolster casting body.

In accordance with the present invention, the riser removal device 10 comprises a frame 14 movably supported by a suspension means 16, a locating means 18 on said frame 16 for engaging with a retaining means on a casting A. A reciprocable means 20 on said frame 14 engagable with a riser, and means for actuating said reciprocable means 20 whereby said reciprocable means 20 exerts a force causing said projection 12 to be separated from the casting A.

Figure 4:
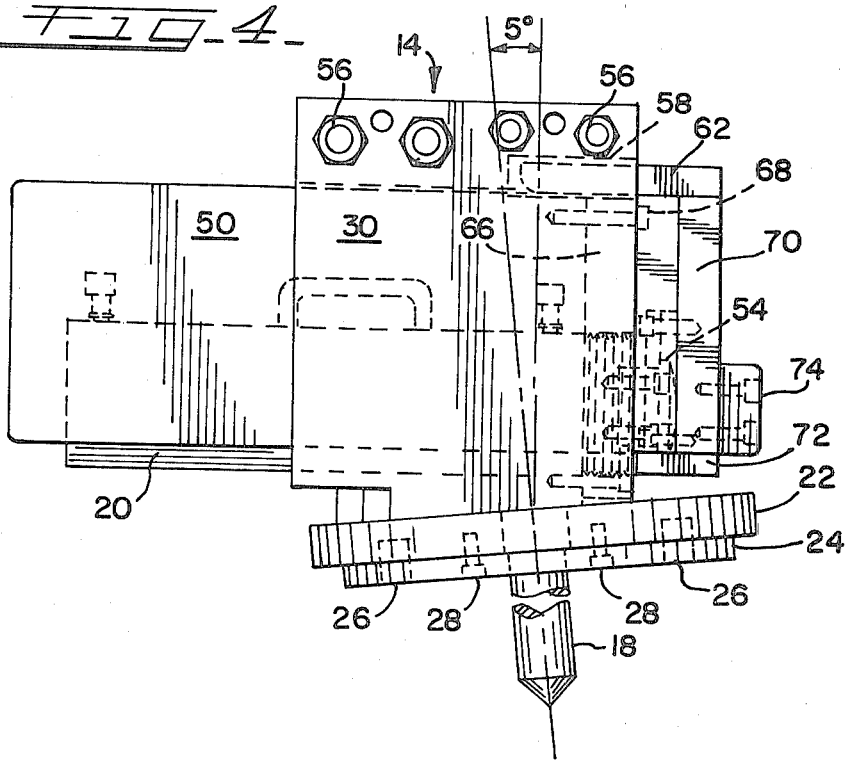
FIG. 4 is a side elevation view of the device of FIG. 3, taken along line 4—4, showing a piston head in a retracted position.
Figure 5:
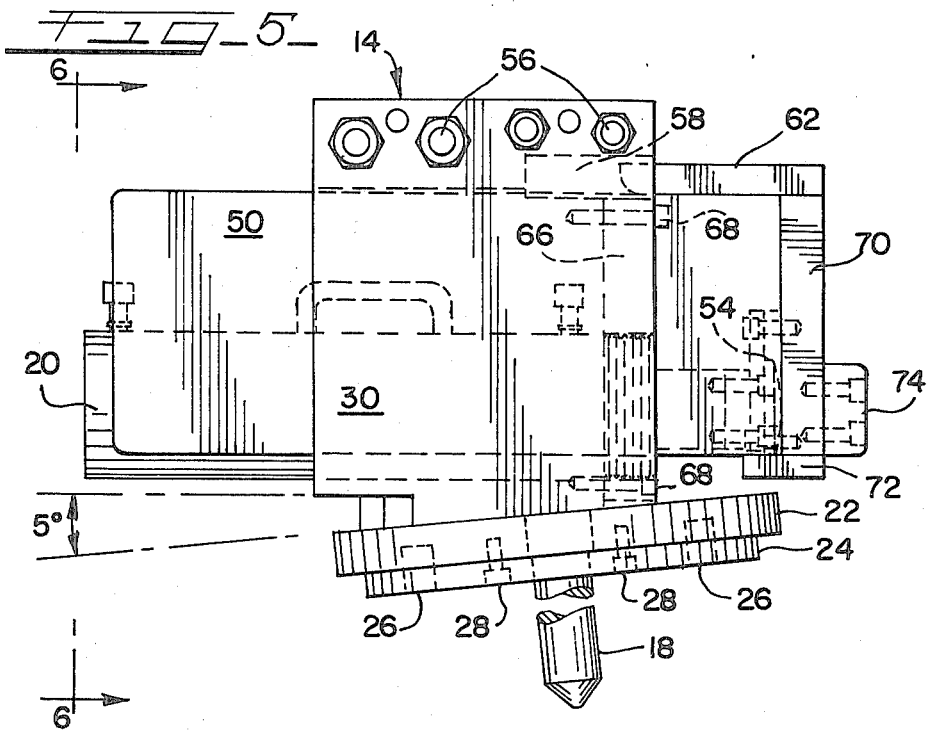
FIG. 5 is a side elevation view of the device of FIG. 4, showing the piston head in an expanded position.

The frame 14 comprises a base plate 22, shown resting on the rim portion of a center plate B. A smaller diameter adapter plate 24 of circular shape is secured concentrically to the lower portion of base plate 22 by a plurality of plugs 26 and screws 28 as shown in FIGS. 4 and 5. The adapter plate 24 is disposed in the bowl area of the center plate portion, contacting the center plate B providing an area to transmit force between the device 10 and bolster casting A. For the purpose of maximizing the contact area between the device 10 and the bolser casting A, it is advantageous to use an adapter plate of slightly smaller diameter than the bolster center plate diameter. For example, a 16 inch and a 14 inch diameter center plate may use a 15¾ inch and a 13-11/16 inch diameter adapter plate respectively.

Figure 6:
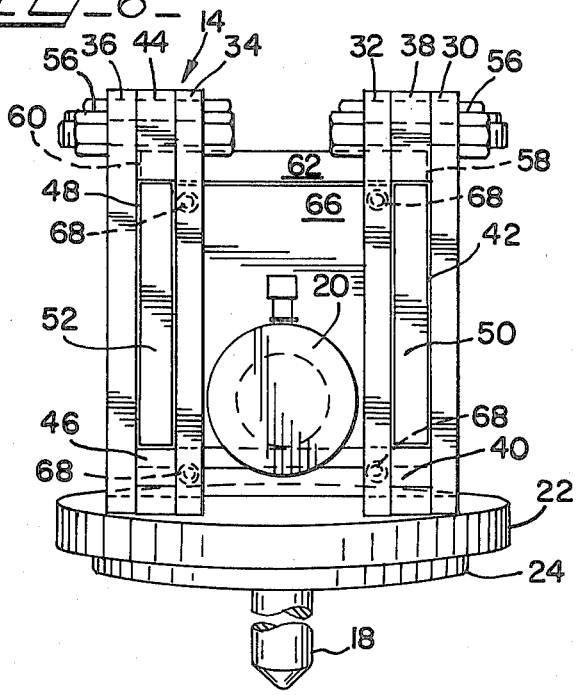
FIG. 6 is an end elevational view of the device of FIG. 3, taken along line 6—6.

As shown in FIGS. 4 and 6, said frame means 14 further comprises four laterally spaced and upwardly extending brackets 30, 32, 34, and 36 secured to the upper portion of the base plate 22. These brackets may be secured to the base plate by welding, bolting or any other suitable means. It should be noted that the vertical axis of the brackets 30, 32, 34 and 36 is at a clockwise 5° angle offset from the vertical axis of the base plate 22 for reasons to be disclosed hereinafter.

Spacing brackets 38 and 40 are placed between brackets 30 and 32 along the respective top and bottom lengths of the brackets so as to define an opening 42 between brackets 30 and 32, shown particularly in FIG. 6. Similar spacing brackets 44 and 46 are placed between brackets 34 and 36 defining an opening 48 between the brackets. Openings 42 and 48 receive slidable vertical ram side plates 50 and 52 respectively. The ram plates are mounted on a piston head portion 54 of a hydraulic cylinder 20. The top spacing brackets 38 and 44 are held between brackets 30, 32 and 34, 36 respectively by a plurality of nut and bolt assemblies 56 along the length of the brackets. Slot 58 and 60 is formed lengthwise along the front portion of brackets 38, 32 and 44, 34 respectively for receiving a portion of a horizontal ram top plate 62.

The hydraulic cylinder 20 may be a 50 ton double acting cylinder such as model RR 5013 manufactured by Applied Power Inc. Source of high hydraulic fluid pressure is supplied at around 10,000 psi by a hydraulic pump (not shown) connecting to the hydraulic cylinder 20 by conduits 64.

As shown in FIG. 6, hydraulic cylinder 20 is mounted to a vertical cylinder holding plate 66 secured transversely between vertical brackets 32 and 34 by a plurality of screw means 68.

The longitudinally reciprocable piston head portion 54 is bolted to a ram face plate 70 having the ram top plate 62, ram side plate 50, 52 and a ram bottom plate 72 welded to the top, side and bottom portions respectively so that said ram plates and piston head portion reciprocate as a unit. The ram face plate 70 has a shoe 74 engagable with the riser 12.

As shown in FIG. 2, device 10 is supportable by a suspension means 16 connecting to a suspension device (not shown) capable of elevating and lowering the suspension means 16 such as a jib crane. The suspension device may be movable laterally along a rail means located above the bolster casting conveyor so that the device 10 may move along with the bolster casting while removing the center plate riser 12 therefrom.

A pair of laterally spaced and longitudinally extending arms 76 are bolted to the frame by a plurality of bolts 56. A pair of space upwardly projecting handle means 78 are formed at the ends of the arms 76 housing control means 80 for the suspension means and hydraulic pump means. Conduits 82 are shown in FIGS. 1 and 2 connecting the control means 80 to the respective suspension means and hydraulic pump means (not shown).

In operation, after removal from the mold, bolster castings including the risers projecting therefrom are placed laterally apart and transported on a conveyor for cleaning and further processing. The riser removal device 10 may be located above the conveyor and lowered by the suspension means 16 onto a bolster casting A while being positioned with the handle means 78 to seat within the king pin 18 in the center plate opening. The device 10 is then rotated to align shoe 74 longitudinally with riser 12. The hydraulic pump is actuated by the control means 80 on handle 78 whereby the piston head 54 of the hydraulic cylinder 20 extends outwardly with a force that separates the riser 12 from its casting A. The insertion of the device 10 into the king pin opening and the actuation of the hydraulic cylinder 20 to fracture and separate the risers may be accomplished in less than one and a half minutes.

Ram plates attached to the piston head are restrained from relative lateral and vertical movements as the plates are being guidably received between brackets of the device during reciprocating motion of the piston. Any radial loads on the piston head will damage the seal resulting in premature cylinder damage.

The brackets 30, 32, 34 and 36 are positioned at 5° below the horizontal to allow for the rising of the device out of the casting upon initial loading. The force required to remove the riser is transmitted through the cylinder 20, brackets and into the casting A thereby eliminating the need for special clamping devices.

After both center plate risers 12 of the casting A are removed by the device 10, it is hoisted by the suspension device 16 and moved to another bolster casting repeating the process of riser removal. It should be readily apparent that device 10 removes center plate risers from bolster castings safely and efficiently without the need for special clamping device by providing a power actuating means for fracturing and separating risers from a casting operable at a safe distance from the casting.

What is claimed is:

1. A device for removing center plate risers from a bolster casting having a center plate opening, said device comprising:

a frame having a pin engagable with said center plate opening, a hydraulic cylinder means on said frame having a movable portion, ram means mounted on said movable portion engagable with said riser, said frame guidably receiving said ram means in the direction of reciprocating movement so as to eliminate radial loads on said hydraulic cylinder, and means to actuate said hydraulic cylinder whereby said hydraulic cylinder exerts a force causing said riser to be separated from said casting.

2. The device as described in claim 1, wherein said frame is positioned at 5° below the horizontal when said pin is seatably engagable with said center plate opening, whereby said device may be permitted to rise out of said casting upon initial loading of said cylinder against said riser.

* * * * *